United States Patent [19]

Keys

[11] Patent Number: 4,545,323

[45] Date of Patent: Oct. 8, 1985

[54] FELT APPLICATOR

[75] Inventor: Steven F. Keys, Churubusco, Ind.

[73] Assignee: Essex Group, Inc., Fort Wayne, Ind.

[21] Appl. No.: 602,250

[22] Filed: Apr. 20, 1984

[51] Int. Cl.[4] ..... B05C 11/00

[52] U.S. Cl. ..... 118/268; 118/269; 118/234

[58] Field of Search ..... 118/264, 265, 266, 267, 118/268, 269, 209, 220, 234; 68/200; 222/187; 401/198, 199, 203, 204

[56] References Cited

U.S. PATENT DOCUMENTS 1,953,863 4/1934 Morrell ..... 118/268 X

*Primary Examiner*—Norman Morgenstern
*Assistant Examiner*—Ken Jaconetty
*Attorney, Agent, or Firm*—Robert P. Hayter

[57] ABSTRACT

A felt applicator including a plurality of complex slits is utilized for uniformly applying a liquid solution to a moving wire. The felt applicator has an entry slit and an angle slit extending from the entry slit such that the wire to be coated is secured at a coating position at the terminal end of the entry slit.

10 Claims, 5 Drawing Figures

FELT APPLICATOR

BACKGROUND OF THE INVENTION

This invention relates to apparatus for applying a solution to a moving wire. More particularly this invention concerns utilization of a felt applicator for applying either a lubricant solution, lubricants or an enamel coating to a wire being drawn through the applicator.

In order to produce magnet wire it is necessary to provide an insulation layer on the exterior of the magnet wire such that the wire may be wound having adjacent turns and layers in the end use and be electrically nonconductive between adjacent turns and layers. In order to provide such a wire it has been common to provide a coating having insulating properties which is applied to the exterior of the wire.

Additionally since the magnet wire is wound into a tightly wrapped configuration such as an electric motor stator or a solenoid or other coil, the wire needs a lubricant on its exterior surface to promote handling of the wire while reducing the potential for wire breakage. The applicator described herein is capable of both applying a lubricant solution to a moving wire as well as applying a coating thereto.

Prior art lubricant dispensing systems have included felt applicators wherein the wire is sandwiched between two layers of felt. The drawbacks to this particular arrangement include a dead area being located on either side of the wire as it is drawn through the felt thereby providing uneven application of a coating or lubricant to the exterior surface of the wire. Additionally, by using a felt sandwich as shown in FIG. 4 herein, it is often required to provide a structure for securing the two portions of the felt to each other to maintain the desired contact to promote wicking of the solution being applied therethrough. An upper rod or a support structure may be utilized to force the top half of the felt sandwich downwardly and may have weights extending therefrom. During those periods of time when tension is removed from the wire it is possible for the wire to engage the structure causing a "wreck" resulting in the manufacturing line being shut down until the wire can be restrung or the problem solved.

The felt applicator as described herein utilizes a specific arrangement including entry slits and angle slits such that the wire is carried within the body of the felt applicator trapped in a slit. By trapping the wire in the slit it is not necessary to provide additional apparatus for maintaining the felt sandwiched together since the slit tends to close on its own. Since this sandwiching apparatus is not present it is possible to eliminate the weights and other support structure which might potentially cause a "wreck" resulting in a shutdown of the production line.

By utilizing a slit to secure the moving wire the amount of dead space about the wire is reduced thereby promoting a more uniform coating of either lubricant or enamel to the exterior surface of the moving wire.

SUMMARY OF THE INVENTION

It is an object of the present invention to provide means for applying a lubricant or coating to a moving wire.

It is a further object of the present invention to provide apparatus for securing a moving wire in position for applying a liquid thereto.

It is a still further object of the present invention to provide means for simultaneously applying a solution to a plurality of moving wires while maintaining those wires secured in an operating position.

It is a yet further object of the present invention to provide a safe, economical, reliable and easy to operate apparatus for securing wires in position and for applying a solution thereto during the drawing of the wires in a production process.

It is another object of the present invention to provide a reliable, long lived and symmetrical felt applicator for applying liquid solutions to a moving wire.

Other objects will be apparent from the description to follow and the appended claims.

The above objects are achieved according to the preferred embodiment of the present invention by the provision of apparatus for uniformly applying a solution to a moving wire. That apparatus includes a tank which is partially filled with solution, means for supplying solution to the tank, a felt applicator, means for securing the felt applicator in an upright position with the applicator having an absorption portion thereof immersed in the solution and an application portion extending above the tank, and said felt applicator defining at least one entry slit extending downwardly from the top of the applicator within the application portion and an angle slit extending upwardly from the entry slit, said moving wire being positioned at the uppermost end of the angle slit such that the slit acts to secure the wire in position and the felt applicator acts to coat the wire with solution wicked through the felt from the tank.

Additionally disclosed is a felt applicator for coating a moving wire. The felt applicator includes an absorption portion immersed in a liquid solution capable of being wicked through the applicator and an application portion defining an upwardly extending angle slit terminating at a coating position wherein the moving wire is secured and an entry slit connecting the angle slit to an exterior surface of the application portion whereby the wire may be inserted into the coating position by serially passing the wire through the entry slit and the angle slit.

DESCRIPTON OF THE PREFERRED EMBODIMENT

The herein invention will be described in reference to the embodiment shown in the attached drawings. It is to be understood that this invention has applicability to other similar applications wherein a liquid is coated on a moving surface. Additionally it is to be understood that the specific number of wires being simultaneously coated, the specific angles of the various slits and the relative locations therebetween are matters of choice for a particular application.

Figure 1:
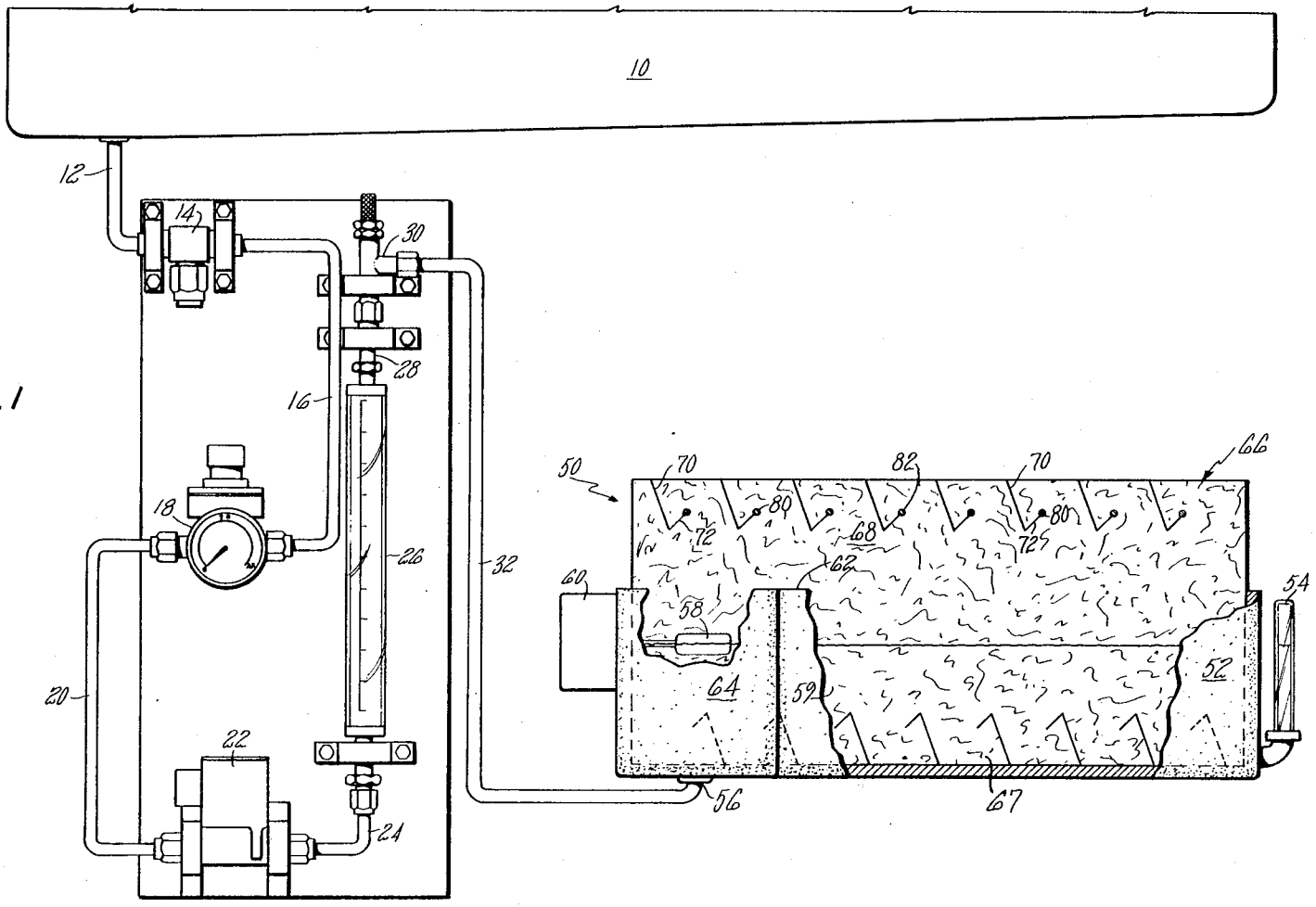
FIG. 1 is a schematic view of a dry lubricant solution application system.

Referring now to FIG. 1 it may be seen that tank 10 contains a quantity of a dry lubricant solution referred to as reservoir 59. This solution typically includes, a small amount of paraffin wax and/or bee's wax in a heptane solvent. When applied to the wire the solvent evaporates leaving the wax on the exterior surface of the wire as a dry lubricant.

Conduit 12 conducts lubricant solution from tank 10 to filter 14. Conduit 16 conducts the lubricant from filter 14 through pressure gauge 18 to conduit 20 to solenoid valve 22. From solenoid valve 22 lubricant flows through conduit 24 to flow meter 26 and from there through conduit 28, through valve 30, and through conduit 32 to tank 52. Filter 14 is used to screen all unwanted particles from the lubricant solution. Pressure regulator and gauge 18 is utilized to regulate and determine the pressure of the fluid being supplied thereto. If the filter becomes dirty or the tank becomes empty the pressure will drop and the operator, by observing the pressure indicated by the gauge, will determine that action needs to be taken. Solenoid valve 22 is provided to selectively prevent further lubricant solution from flowing to tank 52.

Flow meter 26 is used in combination with precision valve 30 to regulate the flow of lubricant solution to the tank. Since the volume of lubricant being applied to the wire is small, the flow meter is utilized in conjunction with the precision valve to regulate the flow to the tank in a precise manner. Additionally by regulating the flow to the tank the level within the tank is controlled to obtain the desired wicking effect to obtain the desired coating thickness on the wire. Should the level in the tank be allowed to rise then the amount of wicking increases dramatically and the amount of coating on the wire increases. Again should the level drop below a desired level, then the opposite happens and the amount of lubricant placed on the exterior surface of the wire is significantly reduced. Hence, it is significant that the valve appropriately control the desired flow rate as indicated by the flow meter to provide a coating level on the wire which is optimal.

Tank 52 defines a reservoir of solution as indicated. Level gauge 54 is mounted at one end of the tank and provides a visual indication of the level of the solution in the tank. Float 58 connected to float gauge 60 is additionally placed in float pocket 64 of the tank, and, as will be later explained, has various electrical connections for indicating certain operating conditions. A proximity switch based on photoelectric, inductive or capacitive sensing could also be used. Lubricant applicator 50 is indicated generically to be the entire assembly of tank 52 containing felt applicator 66. Felt applicator 66 is a rectangular planar felt member extending in an upright position which may be vertical or inclined within the tank such that a bottom or absorption portion 67 of the felt is immersed within the solution and a top or application portion 68 of felt extends above the solution. Additionally application portion 68 at least partially extends above side wall 62 of the tank such that wires 80 may extend through the applicator without engaging the tank per se.

The felt applicator defines an entry slit 70 extending from the top of the applicator downwardly at an acute angle to vertical. From the bottom of entry slit 70, an angle slit 72 extends upwardly a short distance terminating at coating position 82 wherein wire 80 is secured. This coating position is located a distance below the top of the felt applicator such that the wire is secured therein. Upon an easing of tension in the wire, the wire is maintained in the coating position due to the geometry of the entry and angle slits and due to the deformation of the applicator by the continous operation of the wire therethrough. In the particular applicator shown there are eight sets of entry and angle slits designed to act with eight wires being simultaneously lubricated. This applicator is designed such that numerous other application configurations could be used such as more slits or using only half the slits at a time such that on a regular basis the wires could be operated through other slits. Additionally absorption portion 67 of the applicator may be provided with symmetrical slits such that the applicator may be removed from applicator holder 64, inverted and reinserted with the slits which were previously immersed in solution now being the slits at the top of the applicator such that wire may be inserted therein in the same manner as the slits previously described.

Figure 2:
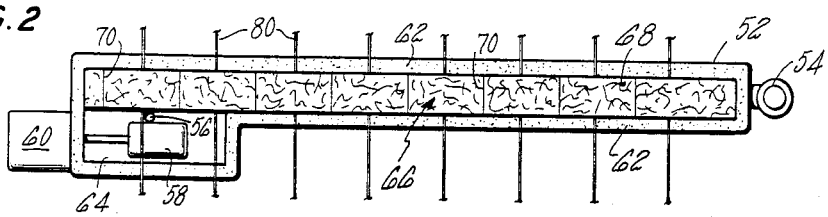
FIG. 2 is a top view of the lubrication applicator of FIG. 1.

FIG. 2 is a top view of tank 52 of FIG. 1. Therein it may be seen that tank 52 defines side walls 62. Float 58 of float valve 60 is shown within float pocket 64 as is connection 56 for conduit 32 to supply solution to the tank. Wires 80 are shown traversing the tank and being located within the applicator displaced a distance from that portion where entry slit 70 terminates at the surface of the felt applicator.

Figure 3:
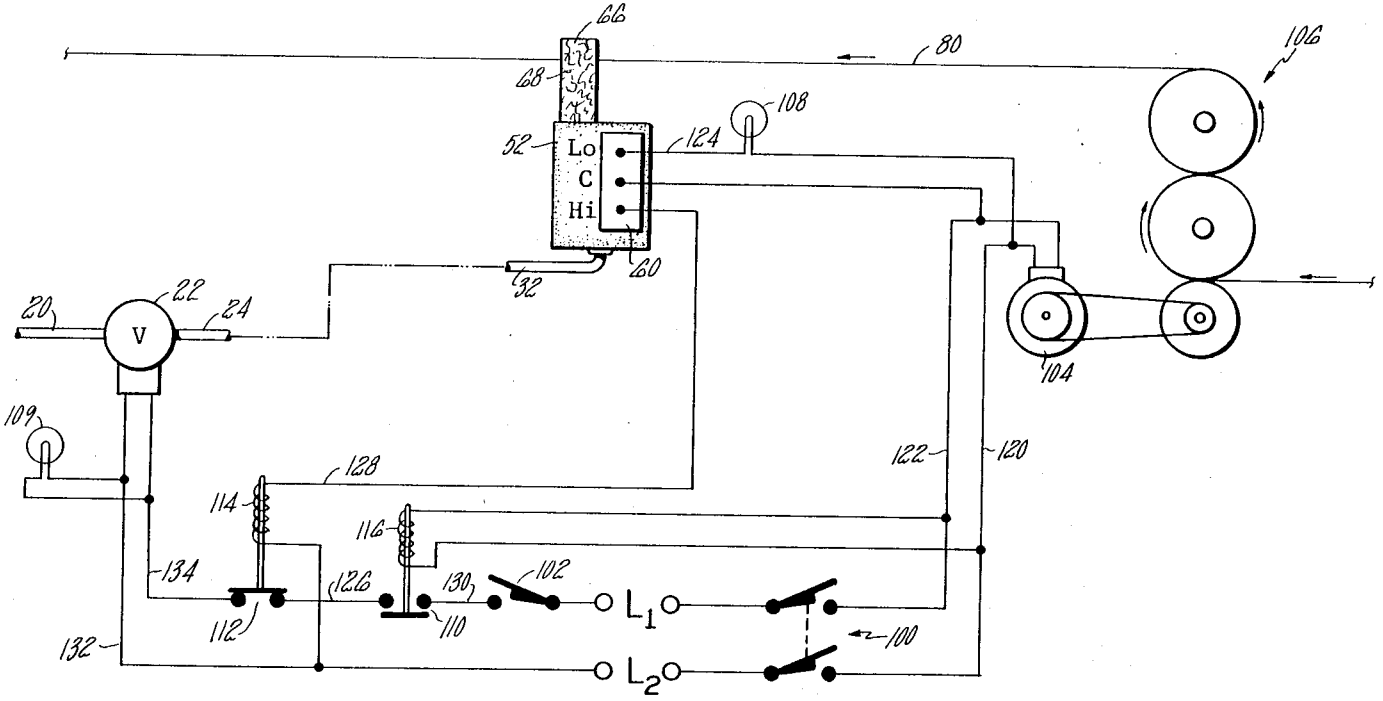
FIG. 3 is a schematic diagram showing a circuit for controlling operation of the lubricant application system.

FIG. 3 is a schematic drawing detailing the manner of operation of a liquid application system. In the schematic it may be seen that wire 80 passes through felt applicator 66 held by holder 64 and is secured in capstan assembly 106. The capstan assembly acts to regulate the speed of the wire passing through the applicator. Capstan assembly 106 is powered by capstan motor 104.

Float 58 mounted within tank 52 senses the level of the solution in the tank and acts to make electrical connections at float gauge 60. These connections are labeled low, C for common, and high such that upon a low level of fluid being detected the low connection is energized, and upon a high level of fluid being detected the high connection is energized.

Solenoid valve 22 regulating the flow of lubricant into the tank is also shown.

Power is supplied from lines L1 and L2 through capstan switch 100 and through wires 120 and 122 to the capstan motor. Additionally wire 120 connects the capstan switch to coil 116 for operating capstan relay contacts 110 and to low solution indicator 108. Wire 124 connects the low level connection of float gauge 60 to low solution indicator 108. Wire 128 connects the high level position of float gauge 60 to coil 114 for operating high solution relay contacts 112.

Solenoid switch 102 acts to connect line L1 through wire 130, through capstan relay contacts 110 if in the closed position, through wire 126, through high solution relay contacts 112 if in the closed position and through wire 134 to solenoid 22 and to solenoid open indicator 109. Wire 132 connects line L2 to coil 114, to solenoid open indicator 109 and to solenoid valve 22.

To operate the production line producing wire, capstan switch 100 is closed energizing capstan motor 104 from lines L1 and L2. At the same time power is supplied to the float gauge 60. Float gauge 60 does not act to energize either the low level or high level contacts unless the float detects a solution level beyond the normal range. Once capstan switch 100 is closed, power is additionally supplied through lines 122 and 120 to coil 116 which acts to close the capstan relay contacts 110 to allow the solenoid valve 22 to be opened. Absent capstan switch 100 being in a closed position, the solenoid valve may not be operated to allow solution to flow to the tank. Hence, upon the production line being shut down by deenergizing the capstan switch, the solenoid valve closes thereby preventing further solution flow to the tank.

Should float gauge 60 detect a low solution condition, then low solution indicator 108 is energized through wire 124 to indicate to the operator that insufficient solution is being supplied to the tank.

Should float gauge 60 energize the high level solution indicator, then coil 114 is energized to break the circuit to solenoid valve 22 to prevent further solution from being supplied to the tank. The solenoid valve is deenergized to prevent further solution being supplied since this solution may be highly flammable and spillage conditions are highly undesirable. Additionally by limiting the level to which the solution may rise the coating of excessive amounts of lubricant on the wires is prevented.

Solenoid open indicator 109 is a visual indicator (may also be an audible alarm) designed to be energized when the solenoid valve is energized allowing lubricant flow therethrough. This light is energized whenever the solenoid switch is closed, the capstan switch is closed closing capstan relay contacts 110 and the high level indicator from the float gauge has not been energized. In this mode the solenoid valve is open and the solenoid open indicator is energized. Should either the solenoid switch or the capstan switch be opened, or the float gauge detect a high level, then the solenoid valve will be deenergized and the solenoid open indicator will not be energized.

Figure 4:
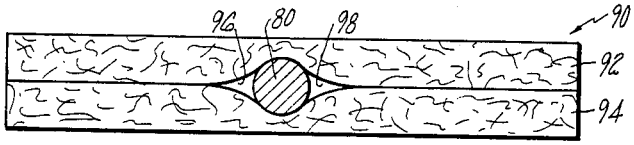
FIG. 4 PRIOR ART
FIG. 4 is a sectional view of a prior art applicator.

FIG. 4 is a sectional view of felt sandwich as known in the prior art. The wire was placed between two layers of felt, one of which was immersed in a liquid solution. The felt would act to wick the liquid solution upwardly and apply same to the wire. The felt would additionally act to wick a portion of the solution from one piece of felt to the other to provide lubricant to both sides of the wire. However as may be seen between upper half 92 and lower half 94 of the felt sandwich 90, there is defined a left dead space 96 and a right dead space 98. Between these dead spaces it is apparent that a significant portion of the wire surface is not in contact with the felt and hence does not have lubricant applied directly thereto. Additionally the interface between the two separate felt portions affects the amount of lubricant being wicked therebetween.

Figure 5:
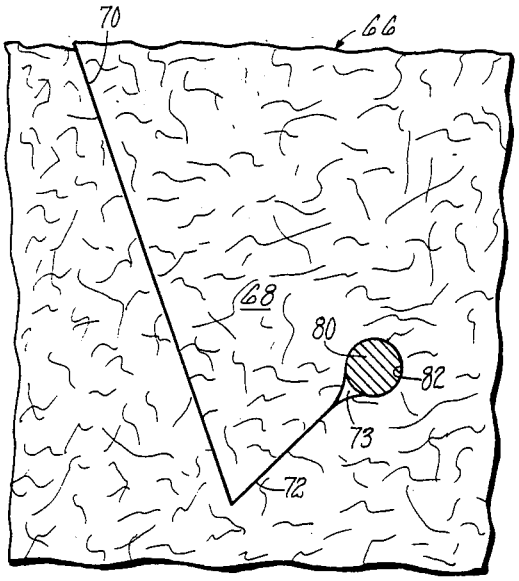
FIG. 5 is a sectional view of the present felt applicator.

FIG. 5 is a sectional view of the herein felt applicator. It may be seen that wire 80 is secured within coating position 82 at the end of angle slit 72. In this position the only dead space is dead space 73 formed within angle slit 72 just prior to wire 80. Entry slit 70 and angle slit 72 are essentially closed except for the dead space immediately adjacent the wire. Since the felt applicator is but a single piece the solution may be wicked entirely around the wire without having to cross an interface between distinct felt portions. In this manner the lubricant may be more evenly applied about the entire surface of the wire to effect a more uniform coating.

The invention has been described with reference to a particular embodiment. It is to be understood by those skilled in the art that variations and modifications can be effected within the spirit and scope of the invention.

I claim:

1. Apparatus for uniformly applying a fluid to a moving wire which comprises:

a tank which is partially filled with a fluid;

means for supplying fluid to the tank;

a felt applicator;

means for securing the felt applicator in an upright position with the applicator having an absorption portion immersed in the solution and an application portion extending above the tank; and said felt applicator defining at least one slit means including an entry slit extending downwardly from the top of the applicator within the application portion and an angle slit extending upwardly from the entry slit, said moving wire being positioned within the slit means such that the slit acts to secure the wire in position and the felt applicator acts to coat the wire with fluid wicked through the felt from the tank.

2. The apparatus as set forth in claim 1 wherein the slit means further comprises a plurality of entry slits extending through the application portion, each slit extending downwardly from the top of the applicator and a plurality of angle slits extending upwardly from the entry slits such that the wire to be coated is secured at the end of the angle slit distant from the entry slit and the wire may be passed through the entry slit prior to being secured within the angle slit.

3. The apparatus as set forth in claim 2 wherein the entry slit extends downwardly at an angle to the top of the applicator and the angle slit extends upwardly from the bottom of the entry slit forming an angle of less than 90 degrees therebetween.

4. The apparatus as set forth in claim 1 and further comprising the felt applicator being symmetrical and having entry and angle slits formed in the absorption portion of the applicator such that inversion of the applicator places the slits from the absorption portion of the applicator in the same position as those in the application portion of the applicator.

5. The apparatus as set forth in claim 4 wherein the wire is magnet wire and the solution being coated thereon is a dry lubricant or oil carried by a liquid solvent.

6. A felt applicator for coating a moving wire which comprises:

an absorption portion immersed in a fluid capable of being wicked through the applicator; and an application portion defining an upwardly extending angle slit terminating at a coating position wherein the moving wire is secured and an entry slit connecting the angle slit to an exterior surface of the application portion whereby the wire may be inserted into the coating position by serially passing the wire through the entry slit and the angle slit.

7. The apparatus as set forth in claim 6 wherein the application portion defines a plurality of spaced parallel angle slits each including a coating position and a plurality of spaced parallel entry slits one connected to each angle slit.

8. The apparatus as set forth in claim 6 wherein the absorption portion of the applicator defines slits symmetrical with the angle and entry slits of the application portion such that the applicator may be inverted and the application portion and absorption portions assume the function of the other portion.

9. The apparatus as set forth in claim 6 wherein the applicator comprises wool felt.

10. The apparatus as set forth in claim 6 wherein the solution being wicked comprises either a wire lubricant or an enamel.

* * * * *